United States Patent [19]

Alvi

[11] Patent Number: 4,637,520

[45] Date of Patent: Jan. 20, 1987

[54] TEST TUBE PROTECTOR

[76] Inventor: Javid R. Alvi, 7970 Larwin Dr., Citrus Heights, Calif. 95610

[21] Appl. No.: 770,494

[22] Filed: Aug. 29, 1985

[51] Int. Cl.[4] ..... B65D 41/52

[52] U.S. Cl. ..... 215/320; 215/354; 150/52 R

[58] Field of Search ..... 215/354, 320; 150/52 R, 150/55

[56] References Cited

U.S. PATENT DOCUMENTS 3,640,418 2/1972 Williams ..... 215/354

3,995,762 12/1976 Pfefferkorn ..... 215/320 X

FOREIGN PATENT DOCUMENTS 7312588 3/1975 Netherlands ..... 215/354

*Primary Examiner*—Donald F. Norton

*Attorney, Agent, or Firm*—Lothrop & West

[57] ABSTRACT

For use with a test tube having a circular-cylindrical wall defining a mouth and having inside and outside surfaces, there is provided a cap of larger diameter than the tube and having a plug adapted to extend into the mouth with interference fit with the inside surface of the test tube. A sleeve on the cap extends along and spaced from the outside surface of the test tube. The sleeve has a greater length than the plug, so that the sleeve still surrounds the test tube wall after the plug has been pulled from the test tube mouth.

3 Claims, 19 Drawing Figures

FIG-2
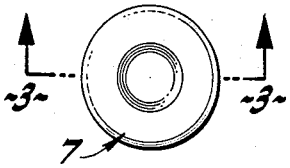
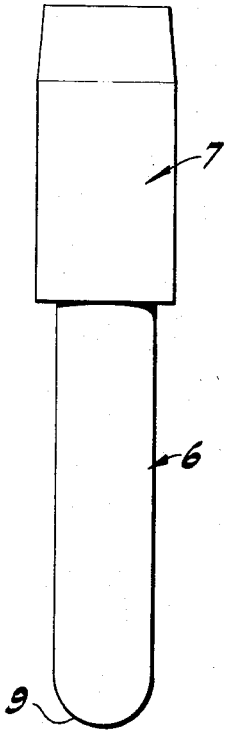
FIG-1
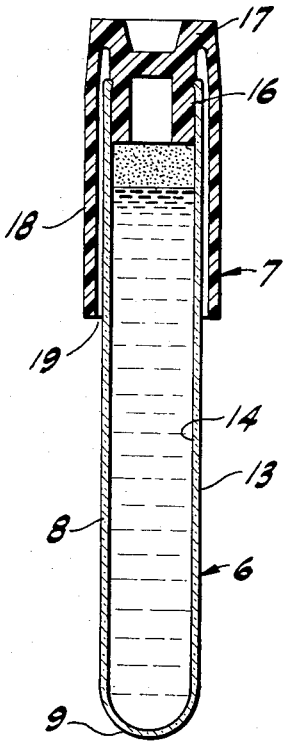
FIG-3
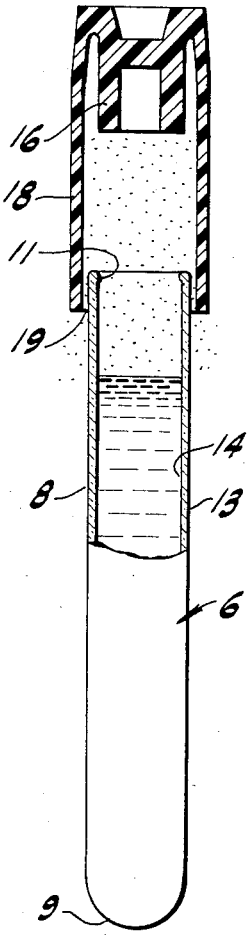
FIG-4
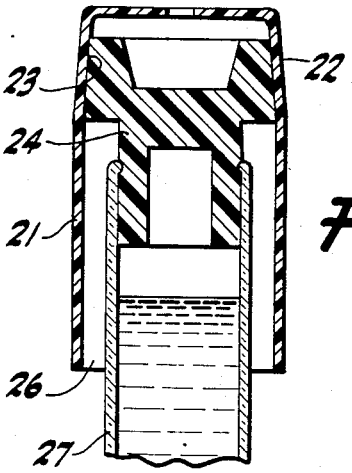
FIG-5

FIG-7
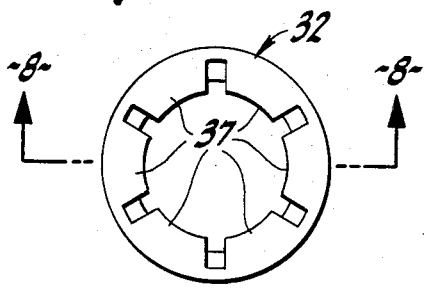
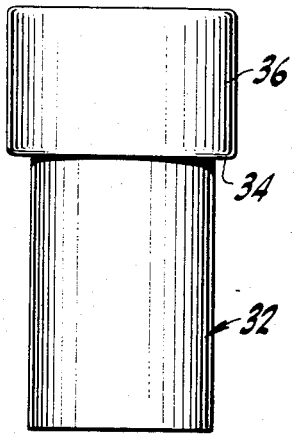
FIG-6
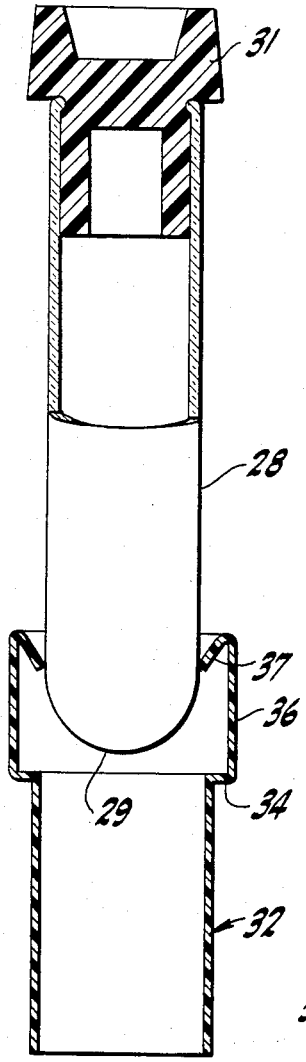
FIG-8
FIG-9
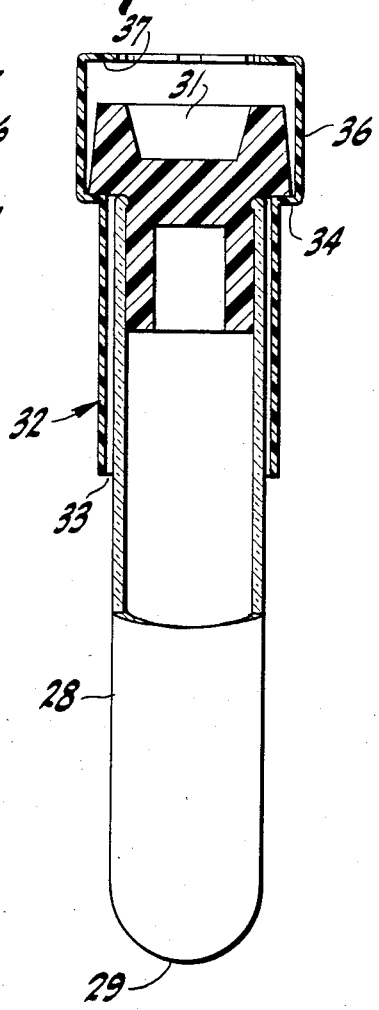

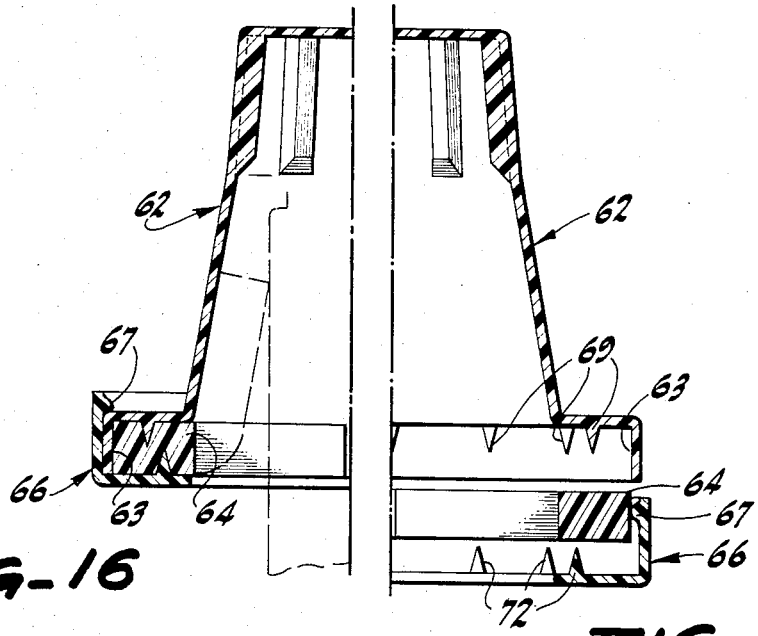
FIG-16
FIG-17
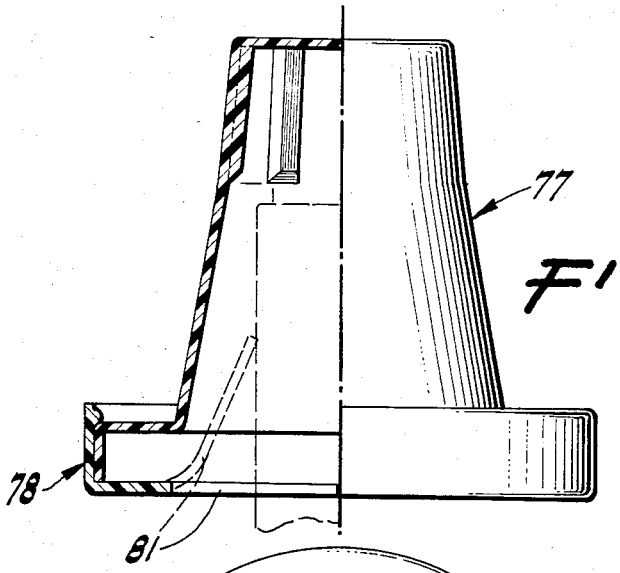
FIG-18
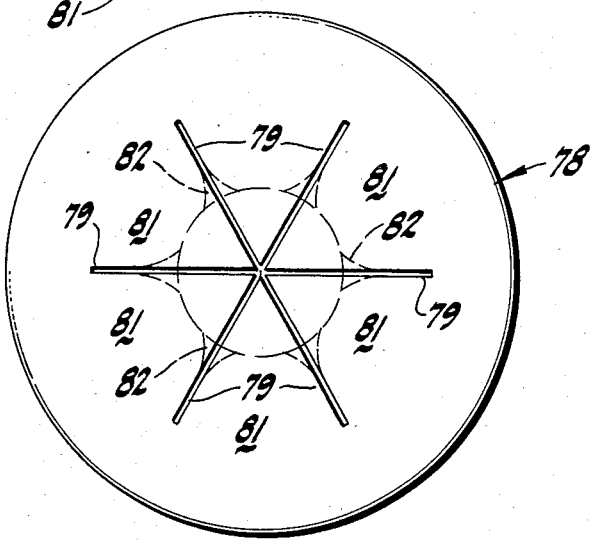
FIG-19

TEST TUBE PROTECTOR

CROSS-REFERENCE TO RELATED APPLICATIONS

The applicant herein is the applicant in an application for U.S. design Ser. No. 06/691,090 filed Jan. 14, 1985.

BRIEF SUMMARY OF THE INVENTION

A test tube protector is for use with a test tube having a mouth defined by a circular-cylindrical wall with an inside surface and an outside surface. A deformable plug has an interference fit with the inside surface and has an overhanging cap of substantially larger diameter than the tube. A sleeve cooperating with the cap extends closely around the outside surface of the tube and has a length greater than the plug. When the plug is dislodged from the test tube, some of the sleeve still extends around the outside of the test tube and limits flow of test tube contents to the atmosphere between the test tube and the sleeve.

PRIOR ART

No particular, pertinent prior art is known to the applicant.

BRIEF DESCRIPTION OF THE SEVERAL VIEWS OF THE DRAWINGS

FIG. 1 is an elevation of a typical test tube with a protector of the invention forming part of the test tube cap.

FIG. 2 is a top plan of the structure of FIG. 1.

FIG. 3 is a cross-section on a longitudinal transverse plane through the test tube and protector as shown by the line 3—3 of FIG. 2.

FIG. 4 is a view similar to FIG. 3 but showing the test tube protector largely withdrawn from engagement with the test tube.

FIG. 5 is a cross-section, like FIG. 3, but showing a modified form of device.

FIG. 6 is a side elevation of a further modified form of device.

FIG. 7 is a top plan of the device shown in FIG. 6.

FIG. 8 is in part a cross-section of the device of FIG. 6, the plane of section being shown by the line 8—8 of FIG. 7, the device being shown as initially applied to a plugged test tube.

FIG. 9 is a view like FIG. 8 but with the device in finally applied position.

FIG. 16 is a left-hand half cross-section, like FIG. 13, showing a further modified form of cap for use with a plug in a test tube.

FIG. 17 is a right-hand half cross-section, like FIG. 16, showing parts of the structure of FIG. 16 is exploded positions.

FIG. 18 is a view like FIG. 16 and showing on the left-hand half a cross-section of a still further modified form of device like FIG. 13 and showing in the right-hand half an elevation of the same structure.

FIG. 19 is a bottom plan view of the device of FIG. 18.

DETAILED DESCRIPTION

Figure 11:
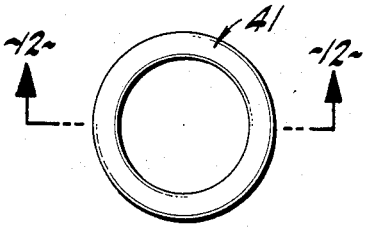
FIG. 11 is a plan of the device of FIG. 10.

In an exemplary embodiment, a test tube is often utilized to contain a noxious or dangerous material. For example, in a hospital a test tube may contain samples of liquids and the like containing virulent components. Under those circumstances the removal of the customary test tube cap is fraught with danger in that the contents of the test tube are immediately exposed to the atmosphere and may contaminate the user and the environment. Further, the test tube may not initially be held upright or in a careful fashion, and the contents may inadvertently be at least partially spilled, with deleterious results.

In order to overcome these difficulties and to do so in a simple, inexpensive and effective fashion, I have provided for use in connection with a standard or exemplary test tube 6 a particular cap 7. The test tube 6 is generally a circular-cylindrical member having a side wall 8 and a closed bottom 9, and its mouth may or may not be provided with an internally extending rim 11 or bead. The side wall 8 of the test tube has an outer surface 13 and an inner surface 14 extending substantially parallel to each other throughout their length so that the tube is of a uniform dimension and thickness.

The closure 7 includes an integral, interior plug 16 preferably of an elastomer or some yieldable material so that in sealing position, as shown in FIG. 1, the plug when fully inserted has an interference fit with the inside surface 14 of the tube and forms a tight closure therewith. The plug 16 may be somewhat conical and in any case at its upper portion expands into a flange 17 forming a finger grip for the closure 7. The closure 7 is particularly augmented by a sleeve 18 of generally circular-cylindrical or annular configuration either integral with the rest of the closure 7 or secured firmly thereto. The sleeve is disposed to extend along the length of the tube 6 in the form of a jacket but is spaced slightly therefrom to provide an intervening clearance space 19. The length of the sleeve 18 is substantially greater than the length of the plug 16, so that when the plug is fully in position the sleeve extends much lower than the lower end of the plug.

In the use of this structure, the plug 16 is removed by a lifting force on the closure 7, preferably by grasping the flange or rim 17. Since the material of the plug 16 is of an elastomeric nature, the plug can readily be twisted and shifted laterally and axially to dislodge it from its sealed position. In so doing, the sleeve 18 is likewise moved transversely, is rotated and is moved axially with respect to the wall 8, the clearance 19 providing for such motions. When the plug 16 is lifted far enough, it is freed from the inside wall and is moved axially away from the mouth of the test tube. Even so, the contents of the tube cannot then readily escape from the tube nor can atmospheric contents readily enter the tube. That is because of the restricted flow passage provided by the still effective small clearance 19 between the inside surface of the sleeve 18 and the outside surface 13 of the tube. Eventually when the closure 7 is lifted sufficiently, the plug 16 is well away from the mouth of the tube and the sleeve has moved telescopically along and finally away from the tube. At that time, the contents of the tube and the atmosphere can readily mix without restriction. During the removal operation, the user can easily govern and regulate the rate of intercommunication between the interior of the tube and the surroundings.

Operating in a similar fashion but not integrally formed is a closure sleeve 21 (FIG. 5) conveniently a separate, cup-like plastic structure that is provided with an upper conical end portion 22 apertured to release air so that it can be forced to wedge firmly upon the conical flange 23 of the plug 24, itself slightly deformable. The sleeve 21 is of considerably greater length than the plug and affords a clearance space 26 around the test tube 27. The sleeve 21 can be applied to existing plugs 24 and can be removed and separately disposed of if contaminated. Its use in conjunction with the plug 24 is as previously described.

A related but differently applied arrangement is also for use with a test tube 28 (FIG. 8) having a rounded lower end 29 and sealed with a plug 31 of the sort previously described. In this instance, as shown in FIGS. 6–9, there is afforded a closure sleeve 32 of a circular-cylindrical configuration slightly larger than the test tube 28 to leave a clearance space 33 between them. The sleeve 32 is not entirely uniform, but has an enlarged annulus 34 merging with a cuff 36 of larger diameter than the plug 31 and of greater axial length than the plug. The cuff has an inturned top made up of a number of radially separate fingers 37 of a flexible nature.

This device is applied by moving the cuff 36 toward the lower rounded end 29 of the test tube and forcing the fingers 37 to deflect inwardly, as shown in FIG. 8. The closure or sleeve 32 is moved further along until the fingers 37 have deflected over the flange of the plug 31. When they have gone axially far enough to clear the plug, the resilient fingers 37 return substantially to a common plane slightly spaced away from the plug 31 but in a position to maintain the assembly of the closure and the plug unless specifically removed. The general operation of this structure is substantially as previously described.

Figure 10:
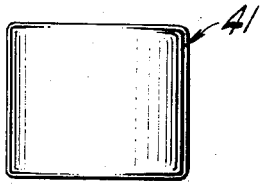
FIG. 10 is a side elevation of another modified form of device.
Figure 12:
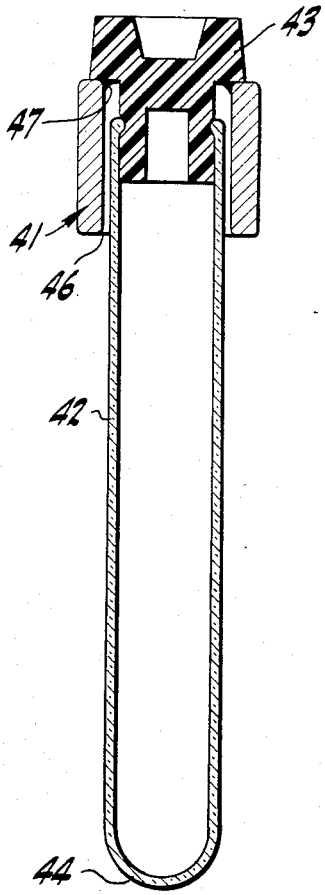
FIG. 12 is a view in cross-section, the plane of which is indicated by the line 12—12 of FIG. 11, of the device of FIG. 10 in a position of use on a plugged test tube.

A simple variation of the embodiments of the invention includes an annular sleeve 41 as shown in FIGS. 10, 11 and 12. This can be a unitary body of somewhat larger interior diameter than the test tube 42 and of greater length than the portion of the plug 43 normally in the test tube. While the sleeve can be somewhat soft and pliable to the touch, it is stiff enough to slide readily over the test tube from the bottom end 44 and to allow a small clearance space 46 when it abuts the flange of the plug. Although this version can be supplied and used as a separate piece, it is often preferred to unite the sleeve 41 with the plug flange by an adhesive 47 or the like, in which case the plug and sleeve act unitarily and in the fashion previously described.

Figure 14:
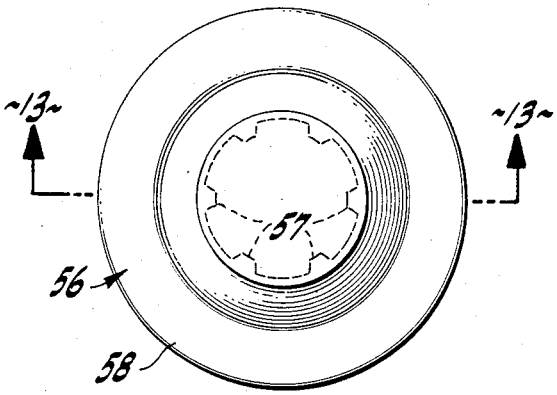
FIG. 14 is a top plan view of the structure shown in FIG. 13 and indicates the section plane of FIG. 13 by the line 13—13.
Figure 13:
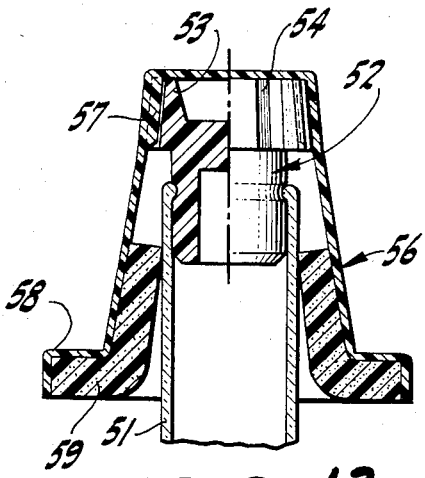
FIG. 13 is a cross-section, like FIG. 5, showing a modified form of cap engaging a plug in a test tube, part of the test tube being broken away.
Figure 15:
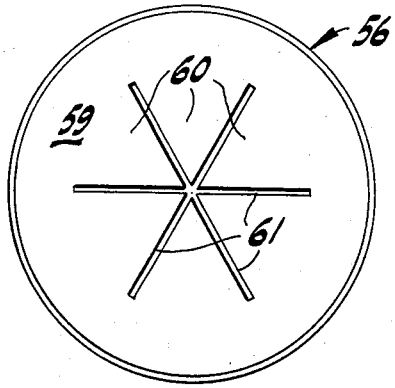
FIG. 15 is a bottom plan view of the structure shown in FIG. 13.

A utilitarian version of an arrangement shown in the applicant's above-noted design patent application is illustrated in FIGS. 13–15. Herein the test tube 51 is as before and has a plug 52 with an upwardly converging conical plug flange 53 having some longitudinally extending grooves 54 therein to aid manual twisting. Adapted to seat on the flange, preferably with an interference fit, is a frusto-conical sleeve 56 having internal ribs 57 engaging in the grooves 54. The sleeve 56 extends well below the bottom of the plug and has an annular enlargement 58 to receive a forced-in disc 59 of sponge or sponge-like material. The disc is radially slit to afford fingers 60. These when at rest are substantially coplanar, but when the sleeve 56 is pushed downwardly over the mouth end of the test tube, the fingers 60 bend upwardly and their tips deform outwardly to provide only narrow gaps or clearance spaces 61 between them for the slow outflow or inflow of test tube or atmospheric materials.

In FIGS. 16 and 17 is a similar structure in which the sleeve 62 has a marginal lower channel 63 to receive a sponge disc 64, slit as before. As shown in these figures, the sponge disc is held by a peripheral cup 66 preferably of slightly yieldable plastic that can be forced onto the sleeve from below. The cup 66 when in place, as in FIG. 16, securely confines the sponge disc, and itself is held in position by a bead 67 that snaps over the edge of the channel portion 63 of the sleeve 62.

As can be seen most clearly in FIG. 17, the edge of the fitting defining the channel 63 is at intervals formed with projecting spikes 69, and the cup 66 is similarly formed with spikes 72. When these parts are forced together, the spikes 69 and 72 pierce the sponge disc 64, and the bead 67 on the cup 66 snaps over the channel 63 on the sleeve 62, thereby holding the parts in assembled position.

In a utilitarian version of the FIG. 16 and 17 form of device, the spikes 69 are eliminated. Even so, a very secure engagement is provided by the plurality of spikes 72 on the cup 66 as the cup is forced onto and snapped over the channel 63 while the spikes 72 pierce the sponge disc 64. The operation of this device, when assembled, is like that of the FIG. 13 version.

As another embodiment, there is afforded, as shown in FIGS. 18 and 19, a sleeve 77 like the sleeves 56 and 62. In this case, the cup 78 is made of a yieldable plastic and has the configuration of the cup 66 except that the cup 78 itself is extended in a planar fashion entirely across the cup bottom and has slits 79 to afford a number of integral fingers 81 that deflect inwardly when the sleeve 77 is forced over the open end of a test tube. Spaces 82 formed between the deflected fingers 81 serve as limited access between the test tube and the atmosphere.

What is claimed is:

1. A test tube protector for a test tube having a side wall with an inside surface and an outside surface and defining an open mouth closed by a cap including a flange having a diameter greater than that of the test tube mouth and having a centrally extending plug of predetermined length adapted to extend through the test tube mouth and sealing by engaging the inside surface of the side wall, said test tube protector comprising:

a. a sleeve having an upper portion conformed to fit closely over the flange and a lower portion spaced from the plug, said lower portion of said sleeve being of more than the predetermined length of the plug and shaped to extend along the outside surface of the side wall with clearance therebetween, the material of said upper portion of said sleeve being laterally deformable by external radial force into firm gripping engagement with the flange to allow removal of the plug by an axial force simultaneously exerted on said upper portion of said sleeve and the flange and dislodging the plug from sealed position; and, b. a sponge disc extending across said lower portion of said sleeve, said sponge disc being radially slit to afford a plurality of resilient fingers upwardly deformable by the test tube as said sleeve is urged downwardly over the mouth end of the test tube.

2. A device as in claim 1 including a peripheral cup confining the bottom peripheral margin of said sponge disc, a plurality of spikes formed on said cup to pierce said disc as said cup is forced against said lower portion of said sleeve, and means for securing said cup on said sleeve.

3. A test tube protector for a test tube having a side wall with an inside surface and an outside surface and defining an open mouth closed by a cap including a flange having a diameter greater than that of the test tube mouth and having a centrally extending plug of predetermined length adapted to extend through the test tube mouth and sealing by engaging the inside surface of the side wall, said test tube protector comprising:

a. a sleeve having an upper portion conformed to fit closely over the flange and a lower portion spaced from the plug, said lower portion of said sleeve being of more than the predetermined length of the plug and shaped to extend along the outside surface of the side wall with clearance therebetween, the material of said upper portion of said sleeve being laterally deformable by external radial force into firm gripping engagement with the flange to allow removal of the plug by an axial force simultaneously exerted on said upper portion of said sleeve and the flange and dislodging the plug from sealed position;

b. a cup of yieldable plastic material mounted on said lower portion of said sleeve and extending in a planar fashion across the bottom of said cup, said bottom of said cup being radially slit to afford a plurality of fingers upwardly deformable by the test tube as said cup is urged downwardly over the mouth end of the test tube; and, c. means for securing said cup on said sleeve.

* * * * *